US006623198B2

(12) United States Patent
Holloway

(10) Patent No.: US 6,623,198 B2
(45) Date of Patent: Sep. 23, 2003

(54) DISPENSER FOR COSMETICS CONTAINING SUNSCREEN

(75) Inventor: Thomas F. Holloway, Southbury, CT (US)

(73) Assignee: Crown Cork & Seal Company, Inc., Oxon (GB)

( * ) Notice: Subject to any disclaimer, the term of this patent is extended or adjusted under 35 U.S.C. 154(b) by 0 days.

(21) Appl. No.: 09/973,212

(22) Filed: Oct. 9, 2001

(65) Prior Publication Data

US 2003/0068187 A1 Apr. 10, 2003

(51) Int. Cl.[7] ..... B43K 21/08
(52) U.S. Cl. ..... 401/78; 401/77; 401/75
(58) Field of Search ..... 401/68, 74, 75, 401/77, 78, 80

(56) References Cited

U.S. PATENT DOCUMENTS

| | | | | | |
|---|---|---|---|---|---|
| 2,797,803 | A | | 7/1957 | Hopgood | 206/56 |
| 2,840,229 | A | | 6/1958 | Hopgood | 206/56 |
| 2,913,103 | A | | 11/1959 | Isele | 206/56 |
| 3,438,714 | A | | 4/1969 | Seaver | 401/78 |
| 3,488,127 | A | * | 1/1970 | Gruska | 401/80 |
| 3,515,493 | A | | 6/1970 | Gruska | 401/74 |
| 3,539,266 | A | | 11/1970 | Hultgren | 401/78 |
| 3,620,632 | A | | 11/1971 | Gruska | 401/78 |
| 3,907,441 | A | | 9/1975 | Idec et al. | 401/75 |
| 4,750,501 | A | | 6/1988 | Ackermann et al. | 132/79 C |
| 5,186,560 | A | | 2/1993 | Holloway | 401/78 |
| 5,186,561 | A | | 2/1993 | Ackermann et al. | 401/78 |
| 5,324,126 | A | | 6/1994 | Holloway et al. | 401/78 |
| 5,636,930 | A | | 6/1997 | Holloway | 401/78 |
| 5,791,799 | A | * | 8/1998 | Oehlhorn | 401/80 |
| 5,842,803 | A | * | 12/1998 | Furnell | 401/78 |
| 6,139,208 | A | * | 10/2000 | Monin-Bareil | 401/78 |
| 6,312,179 | B1 | * | 11/2001 | Gueret | 401/80 |
| 6,412,999 | B1 | * | 7/2002 | Pierpont | 401/80 |

FOREIGN PATENT DOCUMENTS

| | | |
|---|---|---|
| EP | 0 554 974 | 8/1993 |

* cited by examiner

*Primary Examiner*—David J. Walczak
(74) *Attorney, Agent, or Firm*—St. Onge Steward Johnston & Reens LLC

(57) ABSTRACT

A lipstick or cosmetic dispenser having a tubular cam sleeve and an innerbody fitted inside the cam sleeve, and internal helical tracks supporting an elevator cup. The cam sleeve has a lower cam skirt with a plurality of ribs provided on its inner wall. The innerbody has a beveled shoulder around a lower outer wall thereof. The cam skirt ribs bear against the beveled shoulder to create frictional drag between the innerbody and the cam sleeve, and to cause the cam sleeve to be urged upwardly. The ribs on the inner wall of the cam skirt extend at an angle relative to a centerline of said dispenser, and preferably are angled the same direction as the internal helical tracks of the cam sleeve. There are from three to seven, preferably, five or six of said ribs located equidistantly from each other around said inner wall of said cam skirt. The ribs may be connected with each other by webs or separated by slots.

29 Claims, 3 Drawing Sheets

DISPENSER FOR COSMETICS CONTAINING SUNSCREEN

FIELD OF THE INVENTION

The present invention relates to the field of dispensers having a propelling and retracting mechanism for cosmetic products, particularly lipstick products, as well as face sticks and other cosmetics.

BACKGROUND OF THE INVENTION

There has been a trend in the cosmetics product market towards cosmetic products incorporating sunscreens. These sunscreen-containing products create some problems for the operation of propel/retract mechanisms in stick dispensers such as lipstick dispensers. The sunscreen ingredients such as methoxycinnate can damage dispenser components made of styrene.

Desirably, a cosmetic dispenser should have a sufficient amount of swivel drag to give the dispenser a feel that is smooth and luxurious. It is preferable to provide this feel without application of lubricants to the dispenser mechanism, because such lubricants may inadvertently alter or contaminate the cosmetic or lipstick; also, such lubricants represent an additional manufacturing cost that is preferably eliminated.

Conventional propel/repel lipstick dispensers typically have an outer helical cam track sleeve and a longitudinal track innerbody rotatable inside the cam sleeve to axially propel and retract an elevator cup with a lug or lugs that track in the cam track and in the longitudinal track. Various designs are known in the art to provide cosmetic dispensers such as lipstick cases with the desirable amount of swivel drag to give the right feel to the consumer operator when the dispenser is operated to extend or retract the cosmetic stick. It is desirable in providing such a feel that the swivel torque needed to rotate the components to dispense the lipstick remain nearly constant, regardless of whether the dispenser is nearly full or exhausted of the cosmetic. The swivel torque should be significant enough to impart a firm feel to the dispenser. Looseness, uneven drag, or inconsistency of torque can be interpreted by the consumer as indicating an inferior quality product. U.S. Pat. No. 5,324,126 to Holloway and Ackermann, the disclosure of which is hereby incorporated by reference discloses a lipstick dispenser which has a desirable swivel drag.

Pomade back-off occurs when a consumer is using a lipstick dispenser and the force of applying the lipstick to the consumer's lips pushes the pomade and elevator cup down the helical and longitudinal tracks of the dispenser. Pomade back-off is generally prevented when the pomade is fully extended by providing horizontal locking tracks at the upper end of the inner body longitudinal tracks. However, if the consumer does not fully extend the pomade (as can often occur when a new lipstick is being used), the locking tracks are unavailing since the elevator cup is not extended sufficiently to engage in the locking tracks. It is desirable for a dispenser design to address potential problems of pomade back-off. A solution to this problem is provided in U.S. Pat. 5,636,930, the disclosure of which is hereby incorporated by reference.

SUMMARY OF THE INVENTION

It is an object of the invention to provide a cosmetic dispenser which is adapted for use with sunscreen-containing cosmetics, particularly lipstick.

It is an object of the invention to provide a cosmetic dispenser which does not require secondary lubrication to provide the desired feel to the consumer when in use.

It is an object of the invention to provide a cosmetic dispenser which provides a quality feeling without any looseness in the movement of the parts.

These, and other objects, are accomplished by a cosmetic dispenser which comprises a tubular cam sleeve and an innerbody fitted inside the cam sleeve, and internal helical tracks supporting an elevator cup. The cam sleeve has a lower cam skirt with a plurality of ribs provided on its inner wall. The innerbody has a beveled shoulder around a lower outer wall thereof. The cam skirt ribs bear against the beveled shoulder to create frictional drag between the innerbody and the cam sleeve, and to cause the cam sleeve to be urged upwardly. The ribs on the inner wall of the cam skirt extend at an angle relative to a centerline of said dispenser, and preferably are angled the same direction as the internal helical tracks of the cam sleeve. There are from three to seven, preferably, five or six of said ribs located equidistantly from each other around said inner wall of said cam skirt. The ribs may be connected with each other by webs or separated by slots.

Other objects, aspects and features of the present invention in addition to those mentioned above will be pointed out in or will be understood from the following detailed description provided in conjunction with the accompanying drawings.

DETAILED DESCRIPTION OF THE DRAWINGS

Figure 2:
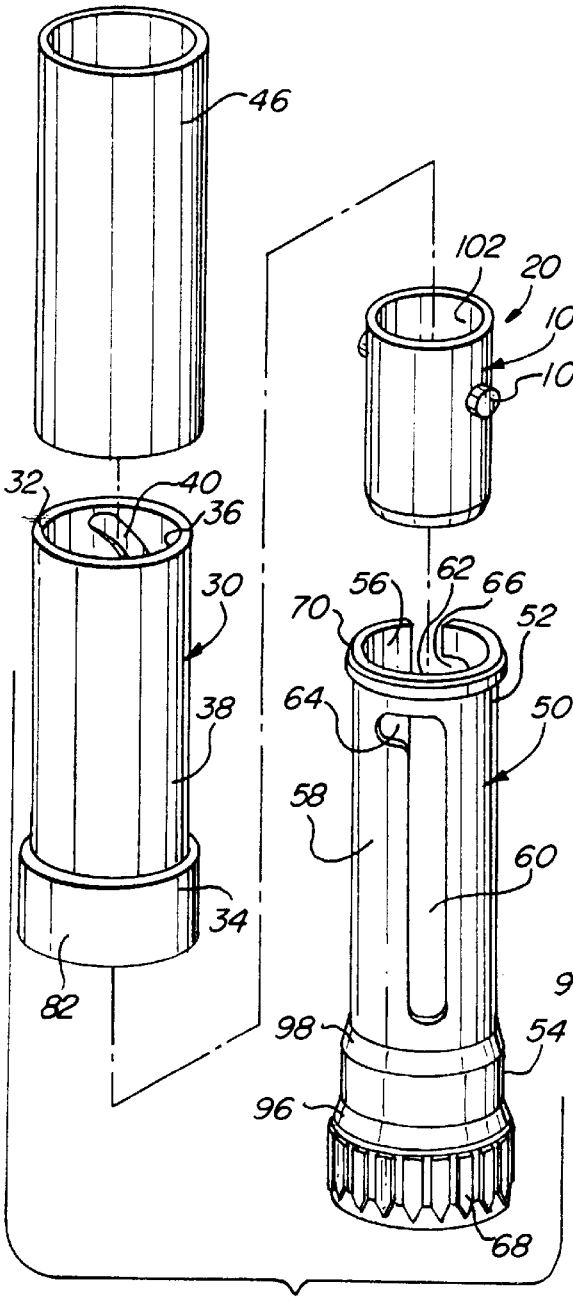
FIG. 2 is an exploded view of the dispenser of FIG. 1.
Figure 1:
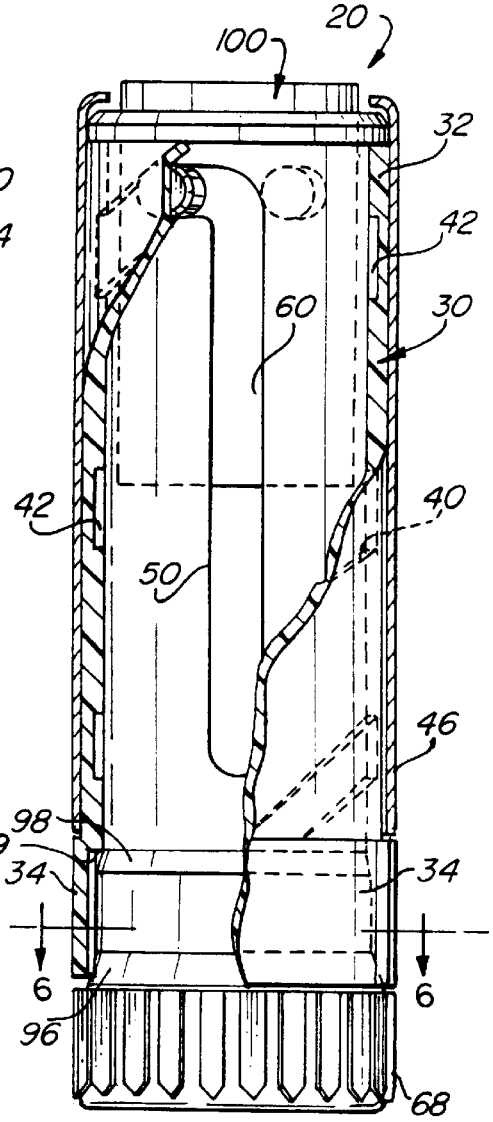
FIG. 1 is a perspective view with a partial cutaway of a first embodiment of a cosmetic dispenser in accordance with the invention.
Figure 3:
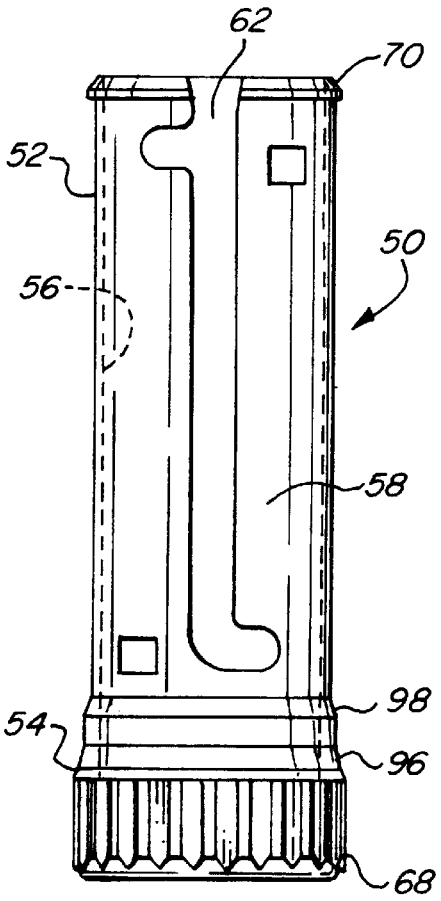
FIG. 3 is a side elevation view of the innerbody of the dispenser of FIG. 1.
Figure 4:
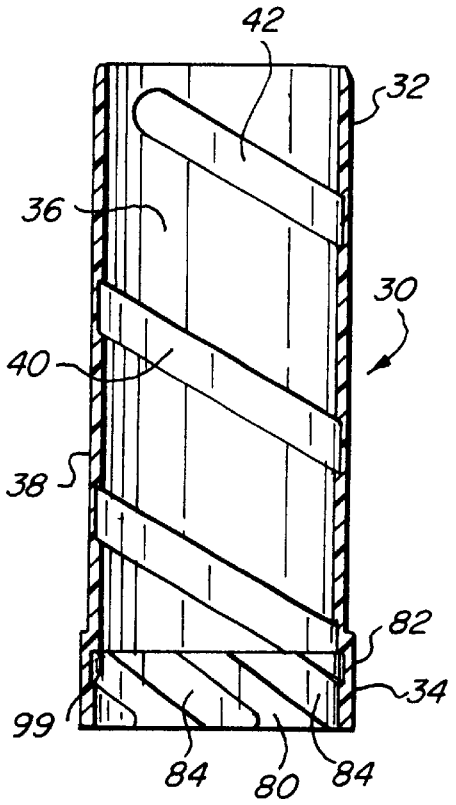
FIG. 4 is a side cross-sectional elevation view of the cam sleeve of the dispenser of FIG. 1.
Figure 5:
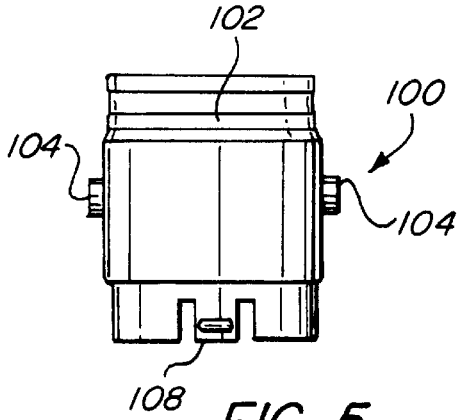
FIG. 5 is a side elevation view of the elevator cup of the dispenser of FIG. 1.
Figure 6:
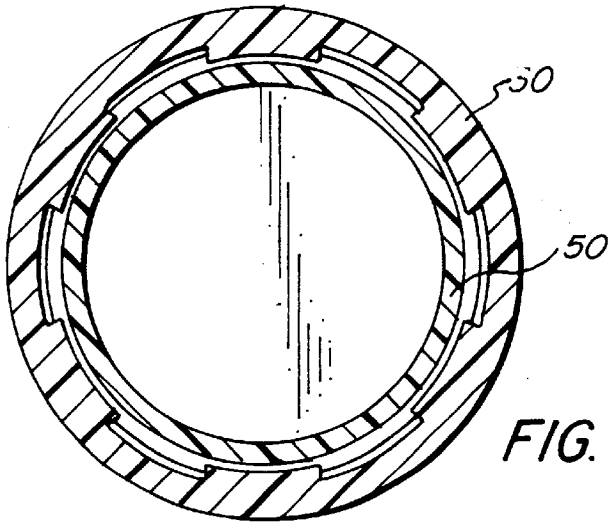
FIG. 6 is a top cross-sectional view along the line 6—6 of the dispenser of FIG. 1.

Referring now to FIGS. 1–8, where like elements are identified by like numbers in the drawings, an improved cosmetic dispenser adapted for use with sunscreen-containing cosmetics is shown generally at 20. Dispenser 20 comprises a cam sleeve 30, an innerbody 50, and an elevator cup 100.

The innerbody 50 is preferably formed by molding from a plastic material, such as polypropylene, or another material selected for its low coefficient of friction and compatibility with the ingredients of the cosmetic stick carried in the dispenser. The cam sleeve preferably is formed from high impact styrene. The combination of the two plastics provides the best swivel drag feel to the consumer, as there is minimal static friction between the two different plastics, thus giving an action which is smooth, without the feeling of sticking. However, it is possible to use high impact styrene for both components.

Cam sleeve 30 is rigid and tubular and has an upper portion 32 and a lower portion. Cam sleeve 30 upper portion 32 has an inner wall 36 and an outer wall 38. At least one and preferably two internal helical tracks 40 and 42 are formed on the inner wall 36. Helical tracks 40 and 42 are located 180 degrees apart and extend along a substantial length of the inner wall 36 of the upper portion of cam sleeve 30. Preferably, each helical track 40 and 42 provides one 360 degree circle in the inner wall 36 of cam sleeve 30. An ornamental outer shell 46 such as a brass tube may be fitted over the outer wall 38 of the cam sleeve for decoration.

Figure 7:
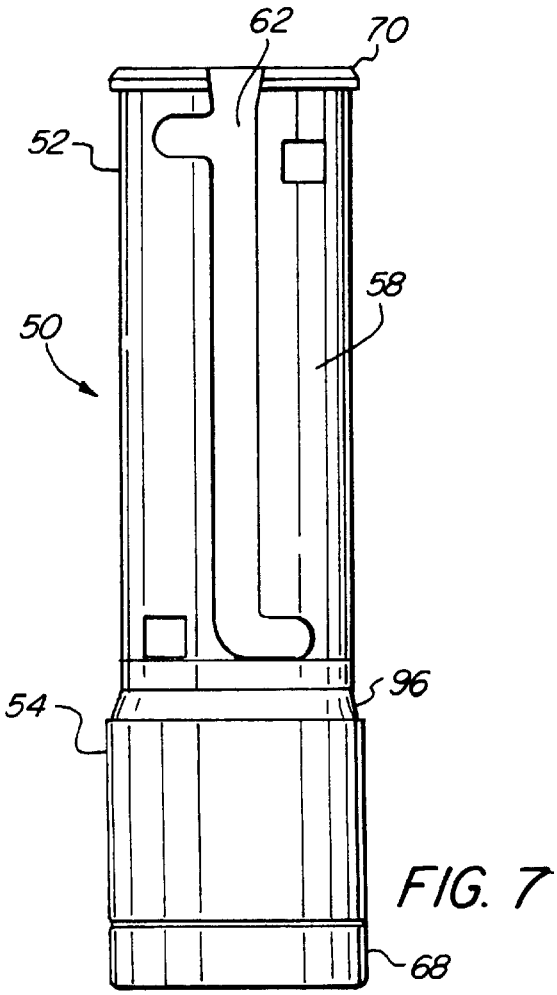
FIG. 7 is a side cross-sectional elevation view of a cam sleeve of a second embodiment of a cosmetic dispenser in accordance with the invention.
Figure 8:
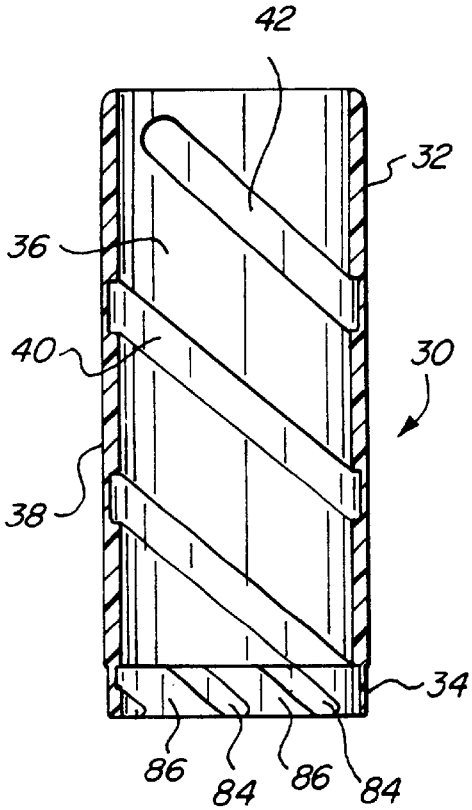
FIG. 8 is a side cross-sectional elevation view of an innerbody of a second embodiment of a cosmetic dispenser in accordance with the invention.

Cam sleeve has a lower portion which is called a cam skirt 34. Cam skirt 34 has an inner wall 80 and an outer wall 82. A plurality of ribs 84 are provided on the inner wall 82 of cam skirt 34. The ribs may be straight or angled relative to the centerline of the dispenser 20. For ease of manufacturing in a die, the ribs 84 preferably extend at an angle relative to centerline of dispenser 20; specifically, the ribs 84 on the inner wall 82 of cam skirt 34 extend at an angle which is oriented in the same direction as the internal helical tracks 40 and 42 of the cam sleeve 30. In one embodiment, as shown in FIGS. 1–6, ribs 84 extend in an angle which is different from the pitch or angle of internal helical tracks 40 and 42. In another embodiment, as shown in FIGS. 7–8, the ribs 84 extend in an angle which is about the same as the pitch or angle of the internal helical tracks 40 and 42.

In one embodiment, cam skirt 34 has an unbroken outer wall 82, e.g., the ribs 84 are connected with each other by webs of plastic material. In another embodiment, cam skirt 34 has slots 86 formed in the outer wall 82, such that ribs 84 are separated by slots 86.

Preferably, there are from three to seven of ribs 84 located equidistantly from each other around the inner wall 80 of the cam skirt 34; most preferably there are from five to six of such ribs 84. The ribs 84 preferably are sized so that they comprise between about 30% to about 70% of the inner wall 80 of the cam skirt 34. Most preferably, the ribs 84 comprise between about 40% to about 60% of the inner wall 80 of the cam skirt 34.

In FIGS. 1–6, the cam skirt 34 has an outer diameter which is greater than the outer diameter of the upper portion 32 of cam sleeve 30. This provides a more convenient design for manufacturing. However, in some cases, it may be desirable to have cam skirt 34 with an outer diameter which is less than the outer diameter of the upper portion 32 of cam sleeve 30, as shown in FIGS. 7–9. The latter arrangement is desirable where a reduced diameter is desirable for design reasons. It allows the cam skirt to be hidden within the metal A-shell 46 which is typically fitted over the dispenser components.

Innerbody 50 is tubular and has an upper end 52 and a lower end 54. Innerbody 50 has an inner wall 56 and an outer wall 58. Innerbody 50 is fitted into the cam sleeve 30 and has at least one and preferably two longitudinal tracks 60 and 62 which extend along the axial length of the innerbody 50 and which extend through the walls 56 and 58 of the innerbody 50 along a substantial length of the innerbody 50. Preferably, one of the longitudinal tracks 62 extends to the upper end 52 of the innerbody 50 so that it is open at its upper end. The other longitudinal track 60 preferably does not so extend so that it is closed at its upper end. This permits easy assembly of the elevator cup 100 into innerbody 50. The longitudinal tracks 62 and 60 preferably have at their upper ends upper lateral track segments 64 and 66 respectively which preferably extend perpendicularly from the longitudinal tracks 60 and 62. The upper lateral track segments 64 and 66 assist the elevator cup 100 to be locked in an extended position for application of a cosmetic.

The elevator cup 100 is generally cylindrical and has a chamber 102 for containing a cosmetic preparation such as lipstick pomade. The cup 100 is fitted into the innerbody 50. Cup 100 has at least one and preferably two cam follower lugs 104 for seating in and following in the longitudinal tracks 60 and 62 of the innerbody 50 and the helical tracks 40 and 42 of the cam sleeve 30. The lugs 104 are located 180 degrees apart and have a sufficient length to extend through the longitudinal tracks 60 and 62 to engage the helical tracks 40 and 42. Cup 100 is movable in an axial path in a conventional manner by relative rotation of the innerbody 50 and cam sleeve 30 by virtue of the lugs 104 seating in the helical tracks 40 and 42 of cam sleeve 30 and the longitudinal tracks 60 and 62 of innerbody 50. The relative rotation of the cam sleeve 30 and innerbody 50 causes the cup 100 to move axially to propel the elevator cup 100 to an extended position, and relative rotation in the opposite direction causes the elevator cup 100 to retract to a retracted position. In one preferred embodiment, the helical tracks 40 and 42 are right hand threads in the cam sleeve 30 and have a thread pitch of about 30 degrees so that each makes one complete revolution as the cup 100 traverses the length of the dispenser 20. This is desirable as only a single turn is needed to fully activate the dispenser 20 or to fully retract the dispenser. The elevator cup may also have friction elements, such as resilient tabs 108 formed on the lower end of the elevator cup 100. Resilient tabs 108 each have an extending bump that bears against the inner wall of the cam sleeve 30 when the cup 100 traverses the length of the cam sleeve 20, providing the desired friction.

The innerbody 50 is interlocked with the cam sleeve 30 so that rotation or application of a swivel torque to the cam sleeve 30 relative to innerbody 50 can be accomplished by gripping an extended cylindrical portion 68 on innerbody 50 with one hand and cam sleeve 30 with the other hand to raise or lower elevator cup 100. The cam sleeve 30 and innerbody 50 are preferably secured together by a retaining lip 70 on the upper end 52 of innerbody 50 that retains the upper end 32 of cam sleeve 30 in place on innerbody 50. The knob 68 of innerbody 50 has a larger diameter than the lower end 34 of cam sleeve 30 and thereby holds the cam sleeve lower end 34 in place.

Innerbody 50 is provided with a first beveled shoulder 96 around a lower outer wall thereof. When the innerbody 50 and cam sleeve 30 are assembled together, the ribs 84 of the cam skirt 34 are held so as to apply pressure against the first beveled shoulder 96.

This interference between the ribs 84 and the first beveled shoulder 96 provides two important benefits. First, the interference creates the desired swivel drag. The swivel drag is consistent along the length of travel of the elevator cup 100, because the swivel drag arises from interference between moving parts that is independent of the elevator cup's position. As noted above, the combination of polypropylene and high impact styrene makes a desirable combination because there is very little initial static friction to overcome when first activating the dispenser. The second benefit of the interference is that the cam sleeve 30 is urged upwardly by the pressure of the ribs 84 against the first beveled shoulder 96. This reduces looseness among the parts, preventing the undesirable extension of the innerbody 50 beyond the end of the cam sleeve 30 and surrounding A-shell 46. Also, the upward pressure of the cam sleeve contributes to swivel drag by the friction between the upper edge of the cam sleeve 30 with the retaining lip 70 of the innerbody 50.

An additional feature of the design is that pressure on the elevator cup 100 will cause the cam skirt 34 to jam against and be frictionally engaged with beveled shoulder 96, preventing undesirable pomade back-off by preventing relative rotation of the innerbody 50 and the cam sleeve 30. This occurs when a downward force, such as the pressure of a consumer's lips, is applied to a pomade carried in elevator cup 100; the pressure is transferred to lugs 104 of elevator cup 100. Lugs 104, being seated in helical tracks 40 and 42, transfer the downward force to the cam sleeve 30. Cam sleeve 30 is thereby moved downwardly slightly until the ribs 84 are jammed against and engage beveled shoulder 96, effectively preventing rotation of cam sleeve 30 relative to innerbody 50 when the innerbody knob 68 is held stationary. This reduces the ability of the elevator cup to retract and consequently alleviates pomade back-off.

Innerbody 50 may also be provided with a second beveled shoulder 98, also around a lower outer wall thereof. The cam sleeve 30 has a segment 99 connecting the upper portion 32 of cam sleeve 30 to the cam skirt 34. Segment 99 can interact with second beveled shoulder 98 to assist in prevention of pomade back-off by frictional engagement of the segment 99 with the second beveled shoulder 98, to further prevent relative rotation of the innerbody 50 and the cam sleeve 30.

An ornamental A-shell such as a brass A-shell 46 will be located over the cam sleeve 30. A cap 110 may be provided to fit over the dispenser cartridge by frictionally fitting onto the A-shell. An ornamental base 112 may be provided to fit into the knob 68 at the base of innerbody 50.

The present invention therefore provides a new and useful cosmetic dispenser with a desirable frictional swivel drag effect.

It is to be appreciated that the foregoing is illustrative and not limiting of the invention, and that various changes and modifications to the preferred embodiments described above will be apparent to those skilled in the art. Such changes and modifications can be made without departing from the spirit and scope of the present invention, and it is therefore intended that such changes and modifications be covered by the following claims.

What is claimed is:

1. A cosmetic dispenser, comprising:

a tubular cam sleeve having an upper portion and a lower portion, said upper portion having inner and outer walls and having an internal helical track extending along a substantial length of the inner wall of the upper portion of said cam sleeve, said lower portion having inner and outer walls and having a plurality of ribs provided on the inner walls of said lower portion, said ribs extending at an angle relative to a centerline of said dispenser;

a tubular innerbody having upper and lower ends, said innerbody being fitted into said tubular cam sleeve and being provided with a longitudinal track extending through the wall of said innerbody along a substantial length of said innerbody; said innerbody having a shoulder around a lower outer wall thereof, said plurality of ribs of said cam sleeve bearing against said shoulder to create a frictional drag; and a generally cylindrical elevator cup for containing a cosmetic preparation, fitted into said innerbody and having a cam follower lug extending through said longitudinal track to engage said helical track.

2. A cosmetic dispenser in accordance with claim 1, wherein said ribs on the inner walls of said lower portion of said cam sleeve extend in an angle which is oriented in the same direction as said internal helical track of said cam sleeve.

3. A cosmetic dispenser in accordance with claim 2, wherein said ribs on the inner walls of said lower portion of said cam sleeve extend in an angle which is about the same as an angle of said internal helical track of said cam sleeve relative to said centerline of said dispenser.

4. A cosmetic dispenser in accordance with claim 2, wherein said ribs on the inner walls of said lower portion extend in an angle which is different from an angle of said internal helical track of said cam sleeve relative to said centerline of said dispenser.

5. A cosmetic dispenser in accordance with claim 1, wherein said ribs on the inner walls of said lower portion are connected with each other by webs.

6. A cosmetic dispenser in accordance with claim 1, wherein said ribs on the inner walls of said lower portion are separated from each other by slots.

7. A cosmetic dispenser in accordance with claim 1, wherein said ribs bear against said shoulder to cause said cam sleeve to be urged upwardly.

8. A cosmetic dispenser in accordance with claim 1, wherein said cam sleeve lower portion has a outer diameter which is greater than an outer diameter of said upper portion of said cam sleeve.

9. A cosmetic dispenser in accordance with claim 1, wherein said cam sleeve lower portion has an outer diameter which is equal to or less than an outer diameter of said upper portion of said cam sleeve.

10. A cosmetic dispenser in accordance with claim 1, wherein there are from three to seven of said ribs located equidistantly from each other around said lower portion of said cam sleeve.

11. A cosmetic dispenser in accordance with claim 10, wherein there are from five to six of said ribs.

12. A cosmetic dispenser in accordance with claim 1, wherein said ribs comprise between about 30% to about 70% of said inner walls of said lower portion of said cam sleeve.

13. A cosmetic dispenser in accordance with claim 12, wherein said ribs comprise between about 40% to about 60% of said inner walls of said lower portion of said cam sleeve.

14. A cosmetic dispenser in accordance with claim 1, wherein said innerbody is formed from polypropylene or styrene; and said cam sleeve is formed from styrene.

15. A cosmetic dispenser, comprising:

a tubular cam sleeve having an upper portion having inner and outer walls and having two internal helical tracks located 180 degrees apart and extending along a substantial length of the inner wall of said upper portion of said cam sleeve, said cam sleeve having a lower cam skirt, said lower cam skirt having inner and outer walls and having a plurality of ribs provided on said inner wall of said lower cam skirt, said ribs on said inner wall of said cam skirt extending at an angle relative to a centerline of said dispenser;

a tubular innerbody having upper and lower ends, said innerbody being fitted into said tubular cam sleeve and being provided with two longitudinal tracks extending through the wall of said innerbody along a substantial length of said innerbody, said innerbody being provided with a first beveled shoulder around a lower outer wall thereof, said cam skirt ribs being located against said first beveled shoulder, said cam skirt ribs bearing against said first beveled shoulder to create frictional drag between said innerbody and said cam sleeve; and a generally cylindrical elevator cup for containing a cosmetic preparation, fitted into said innerbody and having two cam follower lugs located 180 degrees apart and having a sufficient length to extend through said longitudinal tracks to engage said helical tracks, said elevator cup being movable in an axial path by relative rotation of said inner body and cam sleeve to extend and retract said cup.

16. A cosmetic dispenser in accordance with claim 15, wherein said ribs on the inner wall of said cam skirt extend in an angle which is oriented in the same direction as said internal helical tracks of said cam sleeve.

17. A cosmetic dispenser in accordance with claim 16, wherein said ribs on the inner wall of said cam skirt extend in an angle which is about the same as an angle of said internal helical tracks of said cam sleeve relative to said centerline of said dispenser.

18. A cosmetic dispenser in accordance with claim 16, wherein said ribs on the inner wall of said cam skirt extend in an angle which is different from an angle of said internal helical tracks of said cam sleeve relative to said centerline of said dispenser.

19. A cosmetic dispenser in accordance with claim 16, wherein there are from three to seven of said ribs located equidistantly from each other around said inner wall of said cam skirt.

20. A cosmetic dispenser in accordance with claim 19, wherein there are from five to six of said ribs.

21. A cosmetic dispenser in accordance with claim 16, wherein said ribs comprise between about 30% to about 70% of said inner wall of said cam skirt.

22. A cosmetic dispenser in accordance with claim 21, wherein said ribs comprise between about 40% to about 60% of said inner wall of said cam skirt.

23. A cosmetic dispenser in accordance with claim 16, wherein said ribs on the inner wall of said cam skirt are connected with each other by webs.

24. A cosmetic dispenser in accordance with claim 16, wherein said ribs on the inner wall of said cam skirt are separated from each other by slots.

25. A cosmetic dispenser in accordance with claim 16, wherein said ribs bear against said first beveled shoulder to cause said cam sleeve to be urged upwardly.

26. A cosmetic dispenser in accordance with claim 25, wherein said innerbody is provided with a second beveled shoulder around a lower outer wall thereof, and wherein a segment connecting said upper portion of said cam sleeve to said cam skirt will engage with said second beveled shoulder when downward pressure is applied to said elevator cup, to thereby prevent relative rotation of said innerbody and said cam sleeve.

27. A cosmetic dispenser in accordance with claim 15, wherein said cam skirt has a outer diameter which is greater than an outer diameter of said upper portion of said cam sleeve.

28. A cosmetic dispenser in accordance with claim 15, wherein said cam skirt has an outer diameter which is equal to or less than an outer diameter of said upper portion of said cam sleeve.

29. A cosmetic dispenser in accordance with claim 15, wherein said innerbody is formed from polypropylene or styrene; and said cam sleeve is formed from styrene.

* * * * *